US005418699A

United States Patent [19]

Tazawa

[11] Patent Number: 5,418,699

[45] Date of Patent: May 23, 1995

[54] ENERGY CONSERVING MOUNTING ARRANGEMENT FOR TUBE TYPE LIGHTING

[75] Inventor: Kazuyoshi Tazawa, Tokyo, Japan

[73] Assignee: Nissey Corporation, Tokyo, Japan

[21] Appl. No.: 2,841

[22] Filed: Jan. 14, 1993

[51] Int. Cl.[6] ..... F21V 17/02; F21V 17/04

[52] U.S. Cl. ..... 362/255; 362/320; 362/341; 362/433

[58] Field of Search ..... 362/255, 256, 319, 320, 362/341, 433, 217, 260

[56] References Cited

U.S. PATENT DOCUMENTS

| | | | |
|---|---|---|---|
| 3,377,482 | 4/1968 | Podany | 362/255 |
| 3,654,471 | 4/1972 | Nilsson | 362/320 |
| 4,061,422 | 12/1977 | Geurts et al. | 362/320 |
| 4,229,785 | 10/1980 | Tuller | 362/433 |
| 4,642,741 | 2/1987 | Cohn | 362/320 |
| 5,241,462 | 8/1993 | Sugimoto | 362/255 |

FOREIGN PATENT DOCUMENTS 64-10905 1/1989 Japan .

*Primary Examiner*—Richard R. Cole
*Attorney, Agent, or Firm*—Foley & Lardner

[57] ABSTRACT

A reflective arrangement for tube type lighting comprises a reflective sheet of a resiliently flexible heat resistant material arranged behind the lighting tube. Longitudinal edges of the reflective sheet along each side of the lighting tube are protected by molding portions. A pair of clips is attached to the lighting tube, one at each end thereof, each clip having a center gripping portion for gripping the lighting tube and extending arm portions at each side of the gripping portions having retainers for securing the edge of the molding portions at each side of the reflective sheet.

24 Claims, 11 Drawing Sheets

ENERGY CONSERVING MOUNTING ARRANGEMENT FOR TUBE TYPE LIGHTING

BACKGROUND OF THE INVENTION

1. Field of the Invention

The present invention relates generally to a reflecting arrangement for fluorescent lighting. Specifically the present invention relates to an energy conserving method of mounting fluorescent tube type electric lights.

2. Description of the Prior Art

Fluorescent lighting is widely used in many lighting application, particularly office buildings, schools and other environments where large scale lighting is to be economically provided. Tube style fluorescent lighting casts more light for energy expended that light bulbs or the like. However, due to the necessity of conserving energy, even higher efficiency of lighting of has been required.

To meet such requirements, Japanese Utility Model (First Publication) No. 64-10805, for example, discloses one such fluorescent lighting mounting arrangement. According to this, a mirror finished flexible reflective plate is formed, of aluminum or the like, and arranged at a portion of the outer circumference of the lighting tube. Each reflective plate requires a base portion therefore and a plurality of clips for retaining the reflective plate to the lighting tube. Also, the flexible plate must be supported at both sides thereof thus increasing cost and complexity of the reflective arrangement as well as the difficulty of installing same.

Further, according to this construction, a plurality of clip is employed to maintain the reflective plate in a bent state such that warpage of the reflective plate may occur making edges of the plate uneven and difficult to support.

Other methods of increasing light reflected from lighting tubes have also been introduced including reflective steel, or aluminum backing plate formed as part of a lighting tube mounting structure. However such arrangements are expensive and may not be retrofitted into extent lighting systems.

SUMMARY OF THE INVENTION

It is therefore a principal object of the present invention to overcome the drawbacks of the prior art.

It is a further object of the present invention to provide a reflective arrangement for tube type lighting which is inexpensively produced and easily installed.

It is a still further object of the invention to provide a reflective arrangement for tube lighting which may be simply retrofitted into extent lighting systems.

In order to accomplish the aforementioned and other objects, a light reflecting arrangement for a lighting tube, comprising: a reflective film having resilient flexible properties and being provided with a highly reflective finish on at least one side thereof; a pair of molding portions of a length selected to substantially equal a longitudinal length of the reflective film; and a pair of clips, each of the clips having a pair engaging arm portions arranged at one end thereof of dimensions selected so as to partially encircle a lighting tube, the clips further comprising a second arm portion extending outwardly of the engaging arm portions in a direction perpendicular to the longitudinal direction of the lighting tube and having a retainer formed thereon, the retainer being of a configuration so as to enable the retainer to be detachably connected to the molding portions.

DESCRIPTION OF THE PREFERRED EMBODIMENT

Figure 1:
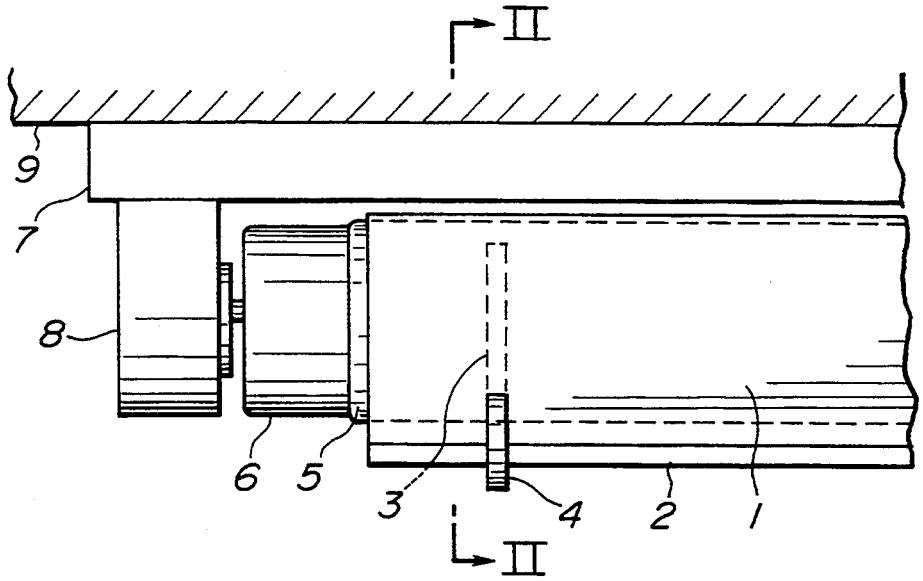
FIG. 1 shows a preferred embodiment of a reflecting arrangement according to the invention installed on a lighting tube type light.

Referring now to the drawings, particularly to FIG. 1, a reflecting arrangement according to the invention comprises a reflective sheet 1, which may be of a two ply polyester film, for example, having a mirror finish reflective surface such as a aluminum vapor finish (i.e. 'Lumirror' tm manufactured by Toray Kabushiki Kaisha which may withstand a temperature of 263° C.) or other suitable material with a sufficiently low heat expansion coefficient. One advantage of the above-mentioned 'Lumirror' material a resilient characteristic which allows the material to resume a flat shape after being flexed, or bent.

It will be noted that due to the characteristics of the material of the flexible plate 1, it is not necessary to prevent the flexible plate 1 from contacting the tube 5.

Also, an edge moulding 2 for retaining longitudinal edge portions of the reflective sheet 1 and a clip portion 4 for mounting the reflective sheet 1 relative a lighting tube 5 are required. As may be seen, no special mounting arrangement for the lighting tube 5 is necessary. An end portion of the tube 6 engages a mounting bracket 8 which is mounted to a base 7 attached to a ceiling 9 of a room, for example, as is well known.

Figure 2:
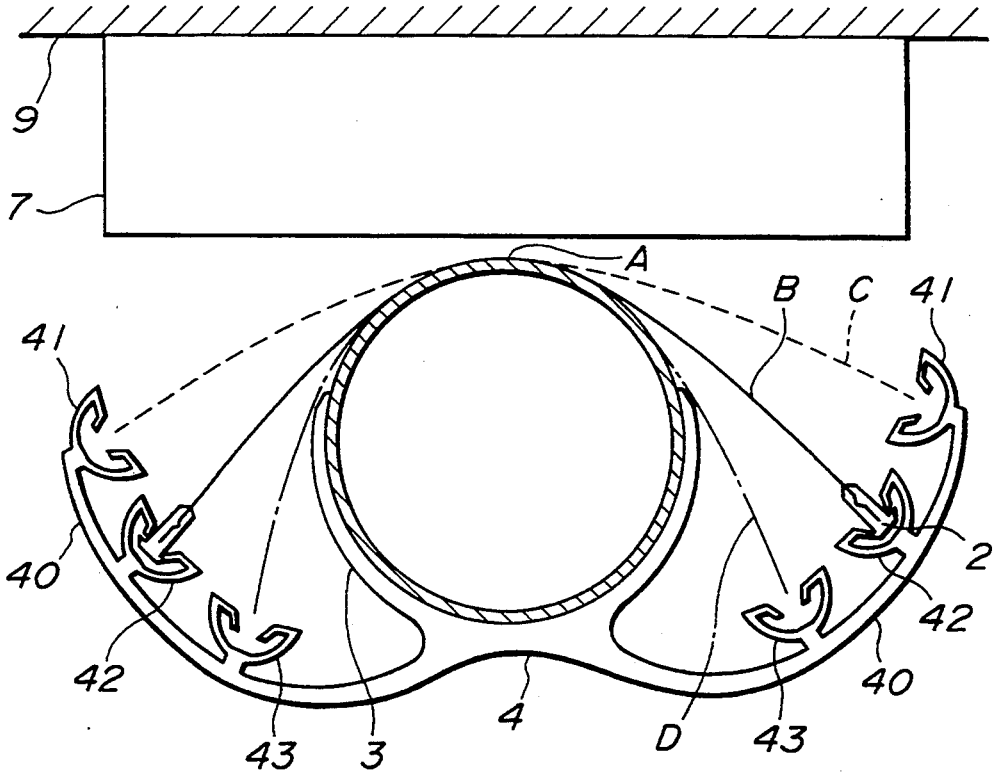
FIG. 2 is a cross-sectional view taken along line II—II of FIG. 1.

Referring to FIG. 2 a cross-sectional view of the clip 4 is shown. As may be seen, the clip 4 is formed out of synthetic resin, metal, or other suitable material, and includes substantially U-shaped tube engaging projections 3 for gripping the lighting tube 5, and outwardly extending arm portions 40 provided respectively with engaging retainers 41, 41, 42, 42 and 43, 43 which are constructed so as to engage the outer side of the moulding 2 for retaining the reflective sheet 1 so as to partially encircle the lighting tube 5 at a desired curve relative the lighting tube 5 according to a desired degree of reflectivity.

In FIG. 2, a curve formed by the reflective sheet 1 when retained by the retainers 41, 41 is B, and when retained by the retainers 42, 42 is C and when retained by the retainers 43, 43, the curve is D.

According to the construction shown in FIG. 2, the reflective plate may be supported by a single pair of clips 4, although, for assuring secure mounting of the reflective plate, a plurality of clips may be used. It will be noted that the retainers 41, 42 and 43 of the clip 4 are substantially C-shaped and have inwardly projecting opposed end portions to provide increased gripping power.

In addition, if the lighting tube is mounted on a wall or in close proximity to a wall, for example, the reflective sheet 1 may be arranged so as to be clipped to the outer retainer 40 on one side of the clip 4 and to the inner retainer 42 or 43, for example, on the other side of the clip 4 such that the reflected light from the lighting tube 5 may selectively be directed to the left or right directions.

Figure 3:
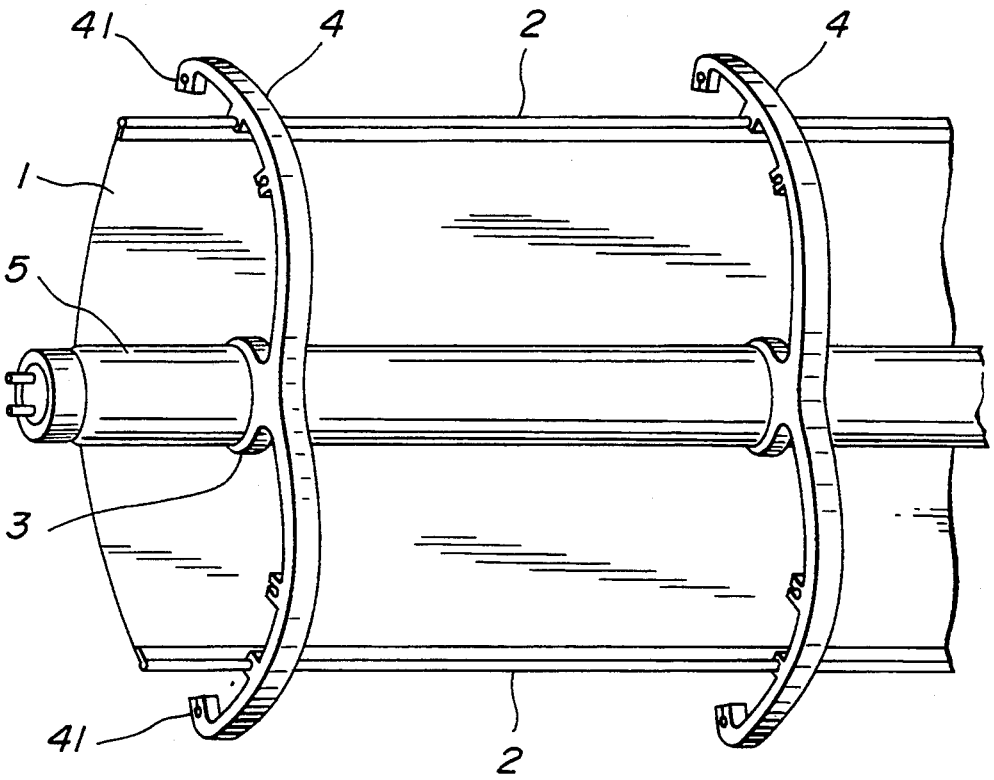
FIG. 3 is a perspective view of the reflecting arrangement of FIG. 1.
Figure 4A:
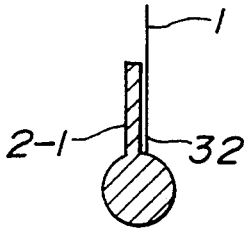
FIG. 4 (*a*)-(*k*) show various modifications of a moulding for retaining edges of a reflective plate.
Figure 4B:
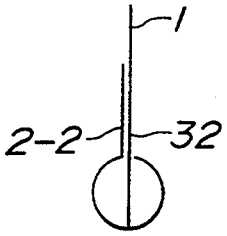
Figure 4C:
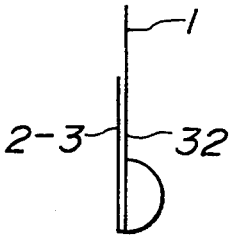
Figure 4D:
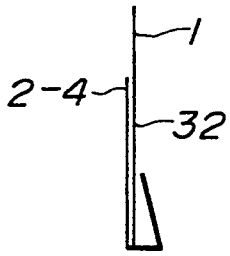
Figure 4E:
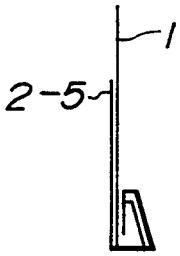
Figure 4F:
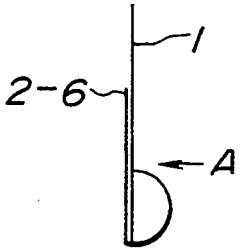
Figure 4G:
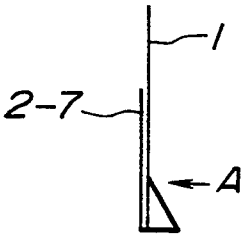
Figure 4H:
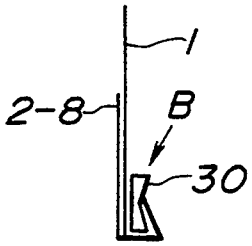
Figure 4I:
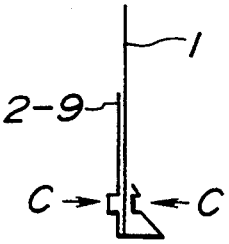
Figure 4J:
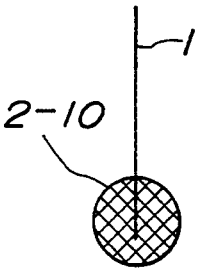
Figure 4K:
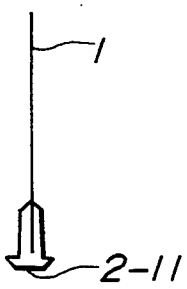

FIG. 3 shows a perspective view of the arrangement of the preferred embodiment as installed on a lighting tube 5. It will be noted from the drawing and the above description of the preferred embodiment that installation of the invention on a lighting tube 5 and subsequent removal or adjustment thereof is extremely simple.

FIGS. 4(*a*)–(*f*) shows a number of modifications to the shape of the molding 2 which may be effected within the scope of the present invention. FIGS. (*a*)–(*d*) include a flat reinforcing surface with supports the edge of the reflective sheet 1 and may be provided with tape, or an adhesive to adhere the reinforcing surface to the reflective sheet 1. FIG. 4(*a*) may be formed of metal or synthetic resin and the edge of the reflective plate is adhered to the reinforcing surface adjacent the thick bottom portion by press fitting or the like. FIGS. 4(*b*)–(*d*) also include the reinforcing surface but are formed of thin flexible metal and may be attached to the edge of the reflective sheet 1 by bending.

FIGS. 4(*e*)–(*g*) show alternative configurations of a molding 2 which also may be easily installed on an edge of the flexible sheet 1 by mechanical means, for example. The moldings of FIGS. 4(*e*)–(*g*) may be formed of a thin bendable metal and include a reinforcing surface and an enlarged lower portion which is rolled with the lower edge of the reflective sheet 1 or alternatively may be pressed in the direction of the arrow A of FIG. 4 for securing the molding 2 to the reflective plate by pinching, or bending pressure applied thereto.

FIG. 4(*h*) is of identical configuration as FIG. 4(*g*), however, according to this modification, a reinforcing retaining member 30 is inserted in the direction of the arrow B of FIG. 4(*h*) for assuring secure gripping of the edge of the reflective plate 1 by the molding 2.

FIG. 4(*i*) shows a modification in which one side of the molding has a concave portion formed therein and the other side of the molding has a corresponding convex portion formed therein, the concave and convex portions may be formed at specific locations along the length of the molding or may be configured as longitudinally extending channels along the entire length of the molding. According to this modification, squeezing pressure is applied in the directions of the arrows C of FIG. 4(*i*) and the edge portion of the reflective sheet 1 is securely held therebetween by being pinched between the concave and convex portions.

FIG. 4(*j*) shows a rounded moulding wherein the edge of the reflective plate 1 may be inserted to a depth so as to be suitably reinforced. This modification is preferable formed of synthetic resin and may be attached by ultrasonic welding, heat fusion, adhesive or the like.

FIG. 4(*k*) shows a stepped, bell-shaped molding portion, this configuration is also shown in the embodiment of FIG. 2. This modification is narrow and may be formed of metal or of synthetic resin. All the modification, the moldings 2 of FIGS. 4(*a*)–4(*j*) may be attached to the retainers 41, 42 or 43 of the clip 4 by simple snap-on operation. The benefit of provision of the molding portions 2 in any of the modifications thereof, is for providing uniform support for securing the reflective plate 1 at a suitable angle according to the position of the retainers 41–43 to which the molding is attached.

Figure 5:
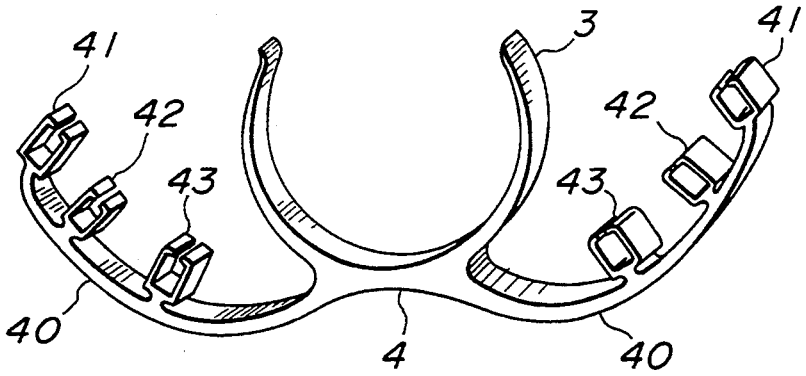
FIGS. 5-7 are perspective views of various modification of a clip portion for retaining a lighting tube and a reflective plate.
Figure 6:
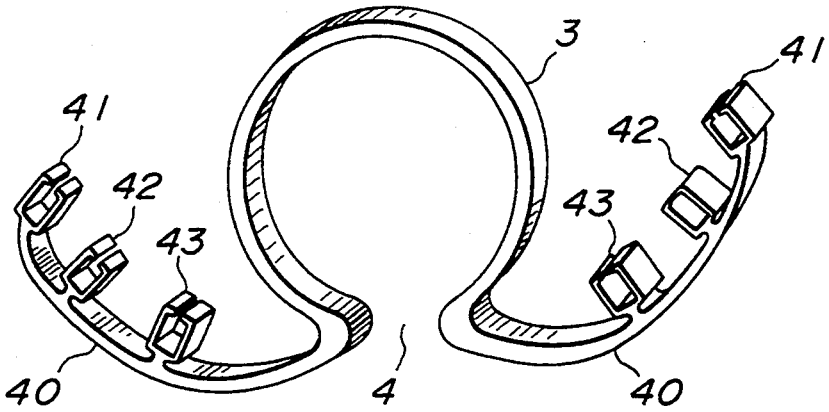
Figure 7:
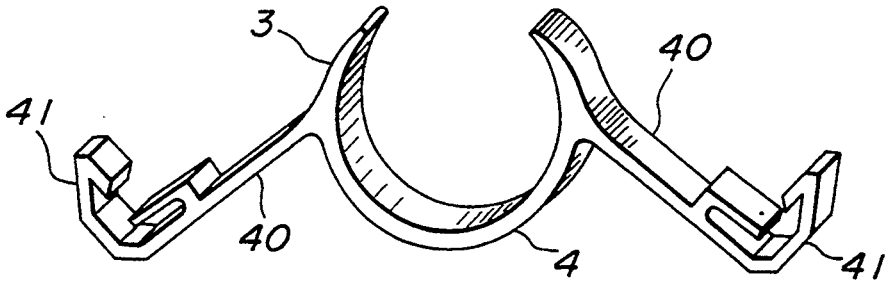

Referring now to FIGS. 5–7 alternative configurations of a clip portion 4 according to the invention will be described in detail.

FIG. 5 shows a clip 4 of essentially the same configuration as the clip of FIG. 2 except for the shape of the retainer portions which are of a simplified C-shape for effectively gripping a wide range of molding shapes. As in the previously described clip 4 of FIG. 2, the clip of FIG. 5 includes a C-shaped gripping portion 3 comprised of two engaging arms for partially encircling the lighting tube 5 for holding the clip in position for mounting the reflective sheet 1.

In FIG. 6 a clip is shown which has the same outwardly extending arm portions 40 as the clips of FIGS. 2 and 5 including the retainers 41, 42 and 43 on each side thereof. According to the modification of FIG. 6 however, the engaging portion 3 is formed by making a C-shaped loop extending upwardly between the outwardly extending arm portions 40. According to this modification, the engaging portion 3 is fit over the lighting tube 5 rather than gripping the tube 5 from beneath. This arrangement provides secure gripping of the lighting tube which will not weaken even if the clip 4 is form of synthetic resin and is subjected to high temperatures, also, its simple configuration allows manufacturing costs to be minimized.

FIG. 7 shows an extremely simple and inexpensive to manufacture modification of the clip 4, according to this modification the engaging portion 3 which grips the lighting tube 5 is similar to the engaging portions 3 shown in FIGS. 2 and 5. However, according to this modification, the outwardly extending arm portions 40 project straight outward and downward from the engaging portion 3 on each side thereof. The outwardly extending arm portions 40 are provided at ends thereof with a single retainer, respectively. The retainer shown in FIG. 7 is similar to that of FIG. 2 in that the end portions of the C-shape which comprises the retainer 41 are bent inwardly to provided increased gripping power.

It will be noted that, if the clips 4 are formed of synthetic resin or other flexible material, the engaging portions 3 may be snapped onto the lighting tube 5 at any location therealong, however, if the clips 4 are manufactured of metal or of an inflexible material they may be slid onto the tube at an end portion thereof and positioned as required after the lighting tube 5 has been mounted in the mounting brackets 8.

It will further be noted that, although three retainers 41, 42 and 43 are provided on each outwardly extending arm portion of the clip 4, alternatively, any other number of retainers may be provided according to the invention. Correspondingly, although a single engaging portion 3 is provided at a central portion of each clip 4, the clip according to the invention may alternatively be provided with a plurality of engaging portions 3 spaced so as to be utilized with lighting arrangements in which a plurality of lighting tubes are mounted parallel to each other.

Finally, although the preferred embodiment of the invention is set forth in terms of a reflective arrangement for fluorescent lighting tubes, alternatively incandescent, ultraviolet or halogen, or any other type of lighting mounted in a tube type configuration may benefit from the advantages of the invention.

Hereinbelow, a second embodiment of the invention will be described with reference to FIGS. 8–10.

According to the second embodiment, a reflective arrangement for tube type lighting is disclosed for a lighting arrangement in which a plurality of tube type lights are mounted parallel to each other.

Figure 8:
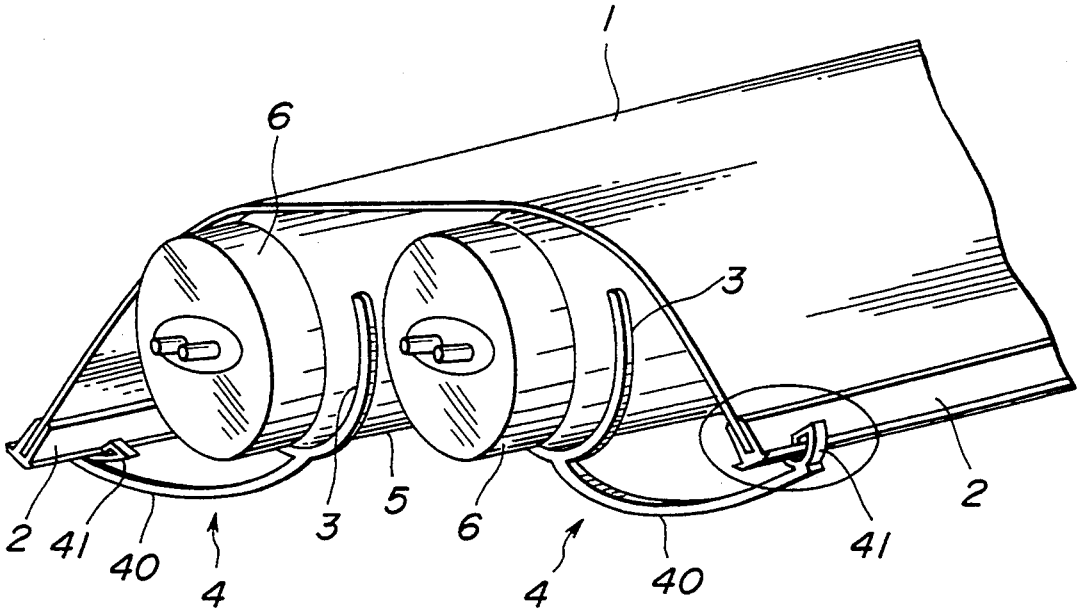
FIG. 8 is a perspective view of an alternative embodiment of the invention for mounting two lighting tubes.

Referring to FIG. 8, the reflective arrangement of the second embodiment comprises a reflective sheet 1 having molding portions 2 installed along longitudinal edges thereof. The reflective sheet 1 and molding portions 2 may be identical to those described in relation to the above-described first embodiment, therefore detailed description will be omitted here for brevity.

The clip 4*a* of the second embodiment differs from that of the first embodiment in that only one outwardly extending arm portion 40*a* is provided, extending in one direction outward of the engaging portion 3*a* which grips the lighting tube 5. A retainer 41*a* is provided at the end of the single outwardly extending arm portion 40*a*, as in the previous embodiment, it is possible to provide a plurality of retainers for allowing the reflective sheet 1 to be disposed at various angles relative the lighting tube 5.

According to the above-described construction, a pair of end clips 4*a*, 4*a* are required each grip an opposite outermost lighting tubes 5*a*, 5*c* of a plurality of parallel lighting tubes 5 . . . 5. In the example of FIG. 8, two parallel mounted lighting tubes 5*a* and 5*c* are provided. As seen in the drawing, the engaging portions 3*a*, 3*a* of the end clips 4*a*, 4*a* grip respective lighting tubes 5*a*, 5*c* at a corresponding position along the lengths thereof with the extending arm portions 40*a*, 40*a* thereof extending in opposite directions outward of the longitudinal center of the lighting arrangement.

Figure 9:
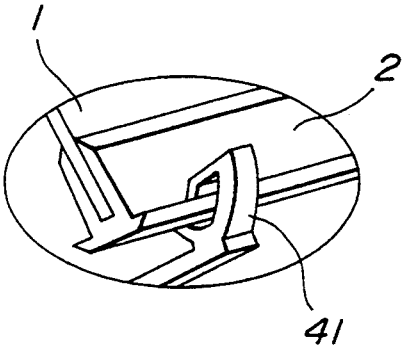
FIG. 9 is an enlarged perspective view of a clip portion engaged with a moulding portion in the embodiment of FIG. 8.

The retainers 41*a*, 41*a* at the ends of the extending arm portions 40*a*, 40*a* of the end clips 4*a*, 4*a* secure the molding portions 2, 2 at each side of the reflective sheet 1, as best seen in FIG. 9. Thus, a balance created between the two end clips 4*a*, 4*a* securely mounts the reflective sheet 1 in the same manner as accomplished in the above-described first embodiment.

Figure 10:
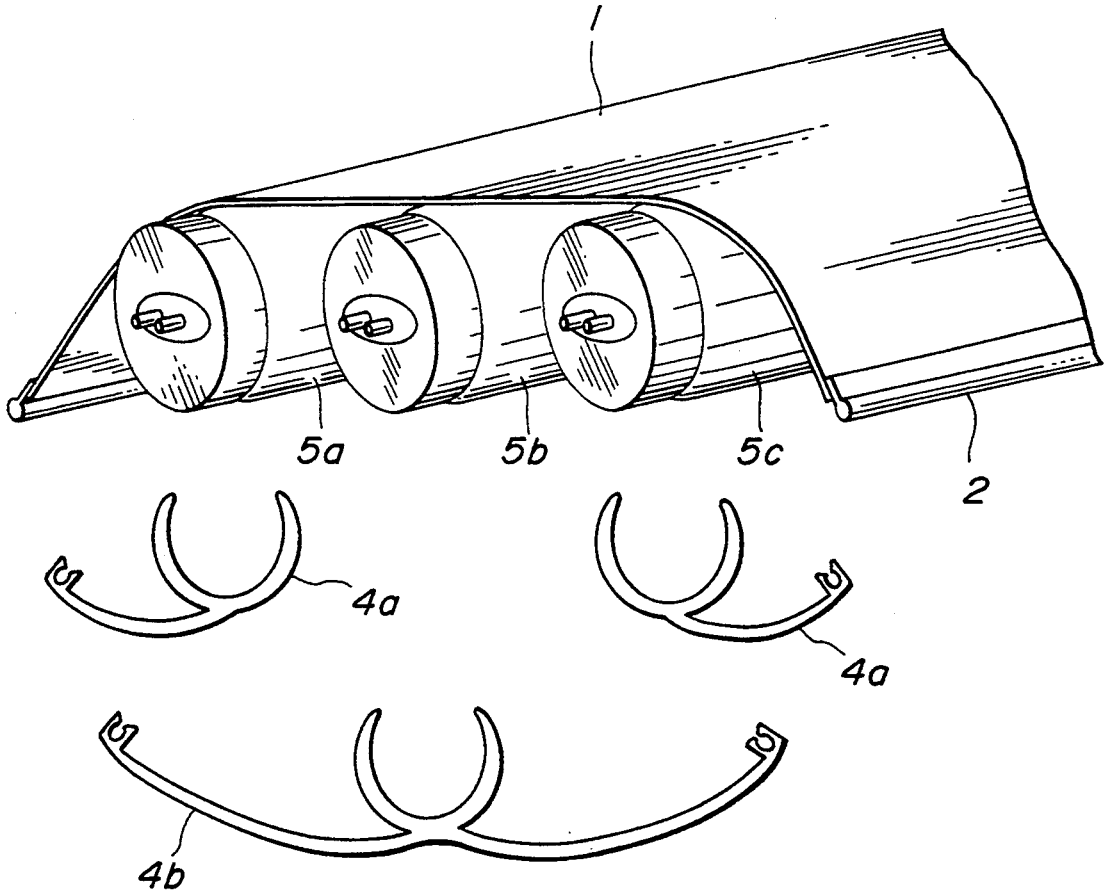
FIG. 10 is a modification of the embodiment of FIG. 8 in which three lighting tubes may be mounted.

Further, as seen in FIG. 10, in a case where three lighting tubes 5*a*, 5*b* and 5*c* are mounted parallel to one another in a single lighting arrangement, a center clip 4*b* may be employed for securely positioning the reflective sheet 1 relative the centermost lighting tube 5. As seen in FIG. 10, the center clip 4*b* includes engaging portions 3*b*, extending arm portions 40*b* of sufficient length to reach the molding portions 2 and at least a single retainer 41*b* at the end of each of the extending arm portions 40*b*. The center clip 4*b* may be employed with the end clips 4*a* as shown in FIG. 10 for effectively and simply mounting a reflective arrangement for a lighting arrangement in which three lighting tubes are mounted.

Figure 11:
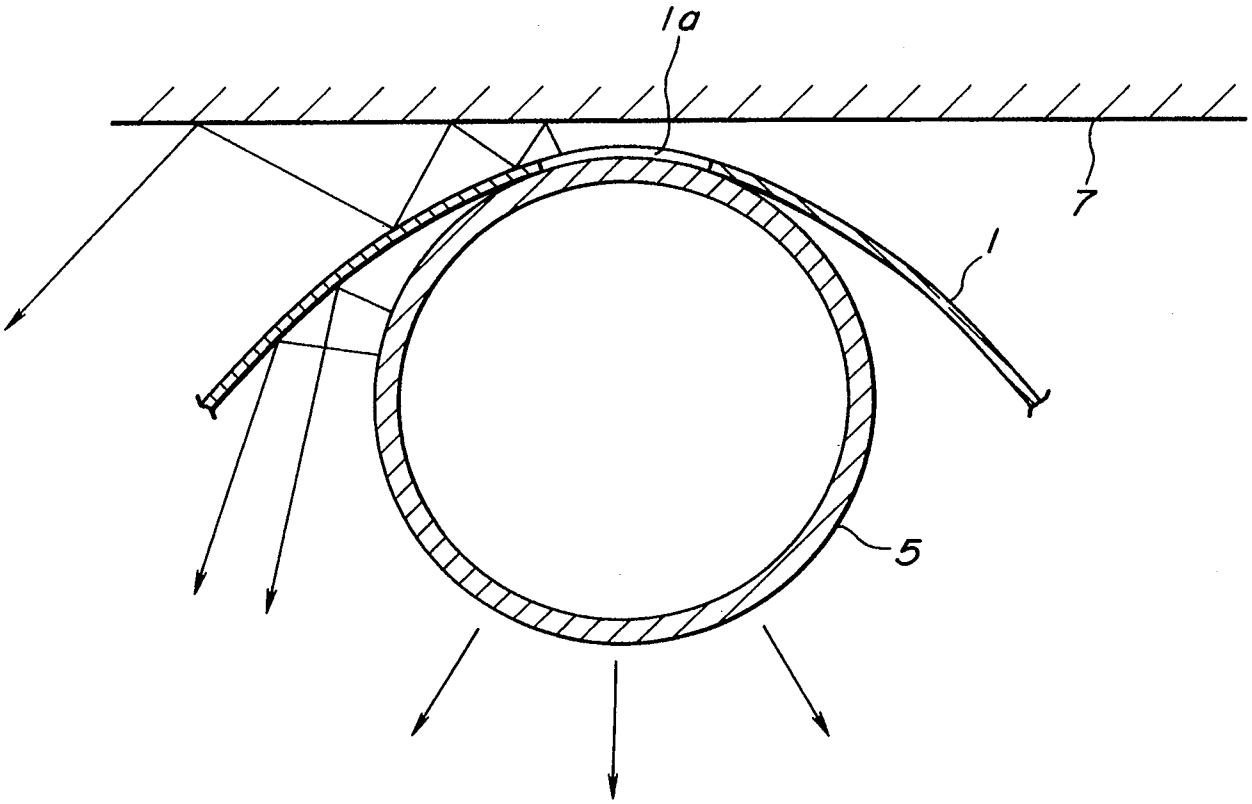
FIG. 11 is a cross-sectional view showing the reflective properties of modification of a reflective plate.
Figure 14:
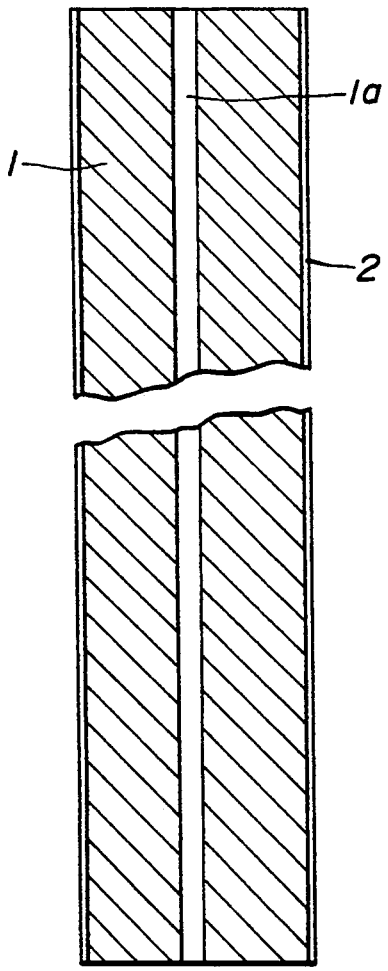
FIG. 14 shows a plan view of a modification of a reflective sheet according to the invention including a transparent window portion formed along the longitudinal center thereof.
Figure 15:
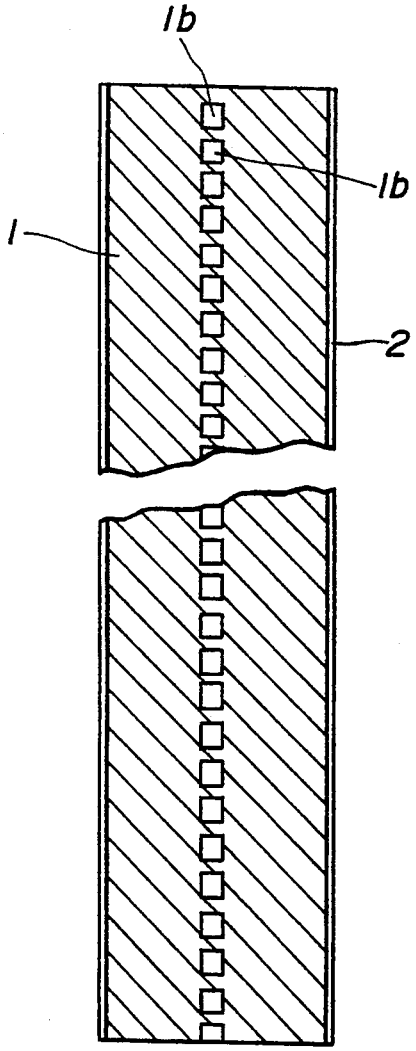
FIG. 15 shows another modification of the reflective sheet of the invention wherein a plurality of transparent window portions are formed aligned along the longitudinal center thereof.
Figure 16:
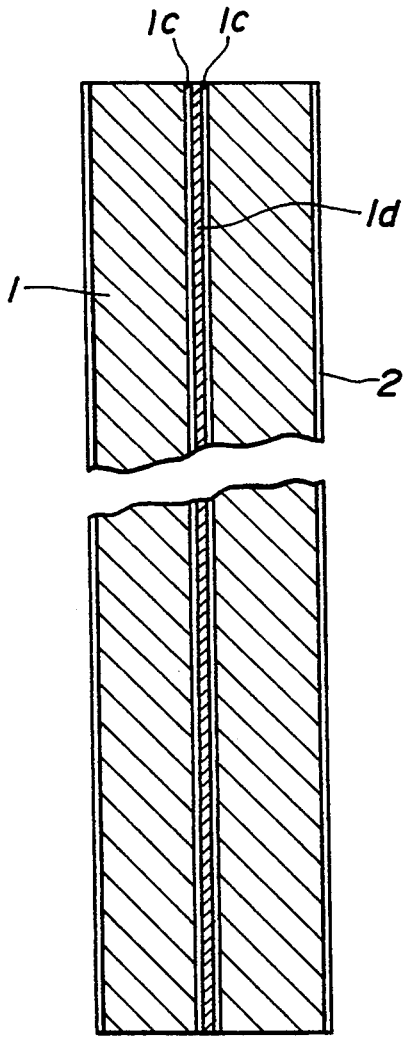
FIG. 16 shows a third modification of the reflective sheet of the invention wherein a plurality of narrow longitudinal transparent portions are formed in parallel along the longitudinal center of the reflective sheet.

Referring now to FIG. 11 a modification of a reflective sheet 1 according to the invention is shown. As seen in the drawing, the reflective sheet 1 according to this modification includes a transparent center portion 1*a* along a longitudinal center thereof. According to this, light radiated from the upper portion of the lighting tube 5 is permitted to escape an reflect from the upper surface of the reflective sheet 1, in addition, according to this modification, the reflective sheet 1 one may have a highly reflective finish provided on both sides thereof. Further, referring to FIG. 14, the transparent center portion 1*a* may be provided along the entire length of the reflective sheet or for a specified length only, or alternatively, as seen in FIG. 15, a plurality of transparent center portions 1*b* may be provided in alignment. Alternatively, transparent portions 1*c* may be provided as a plurality of parallel longitudinal transparent strips 1*c* having reflective areas 1*d* therebetween, provided in the longitudinal center area which is in the vicinity of the lighting tube when the reflective sheet 1 is mounted for use. Also, regarding the width of the transparent center portion 1*a*, according to this modification the width should be equal to or less than the width of the lighting tube 5. According to the above-described construction, maximum advantage is made of both light irradiated by the lighting tube 5 and light reflected by the reflecting sheet 1 to substantially raise the lighting efficiency of the reflecting arrangement which may also work in conjunction with reflective arrangements which may be built into the tube mounting structure.

Figure 12:
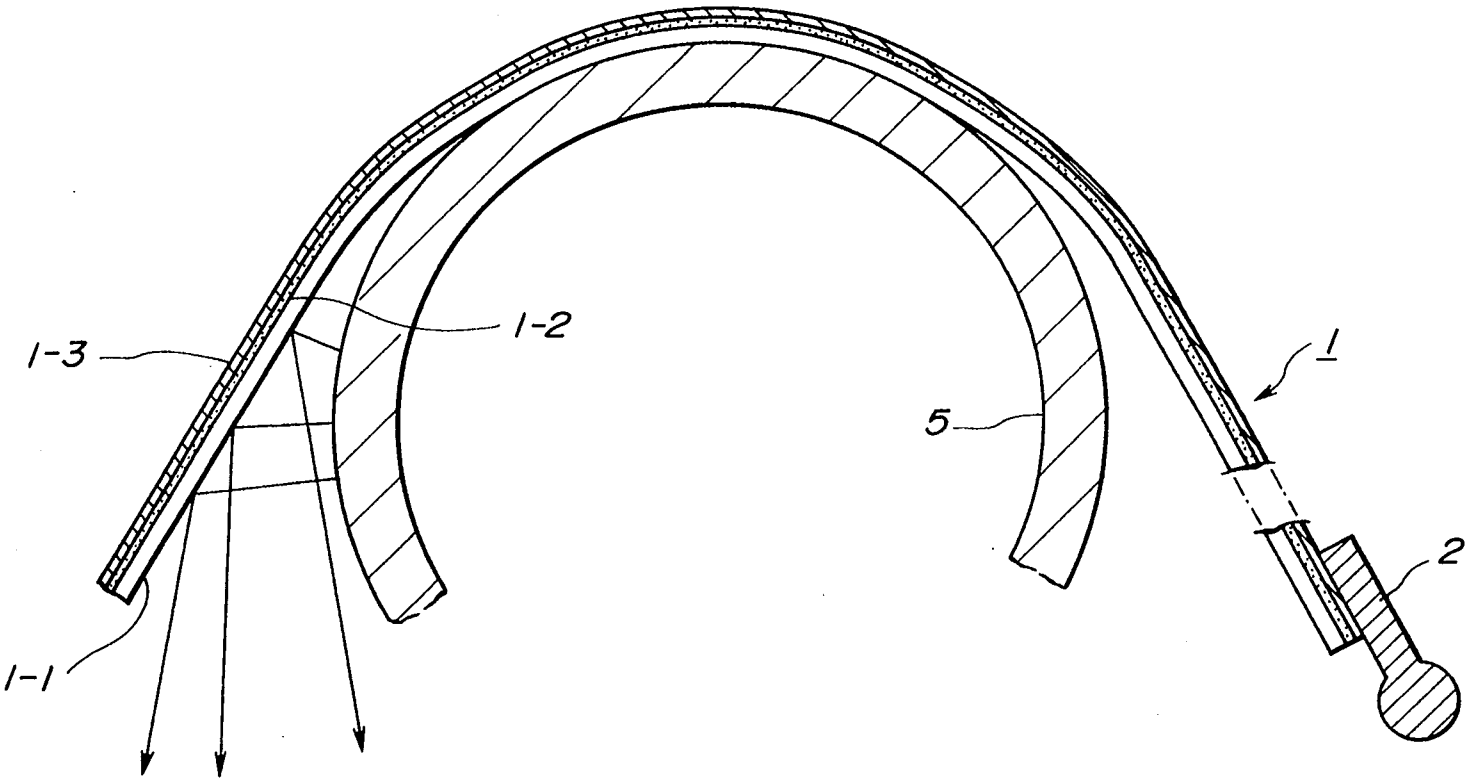
FIG. 12 is a cross-sectional view of a further modification of a reflective plate according to the invention.

Referring now to FIG. 12, another modification of a reflective sheet according to the invention is shown. According to this, the reflective sheet 1 is formed of a plurality of layers 1-1, 1-2 and 1-0. Layer 1-1 being a transparent heat resistant protective layer, layer 1-2 being the reflective film layer, having an aluminum vapor finish, for example, and layer 1-3 being protective, oxidization preventing layer for preventing corrosion and loss of reflectivity of the reflective film layer. According to this construction the durability and longevity of the reflective sheet 1 is considerably extended.

Further, according to the above, the transparent heat resistant layer 1-1 may be tinted for effecting color adjustment of reflected light.

For determining the advantages of the invention, the inventors carried out experiments to determine the degree of increase of illumination when utilizing the reflective arrangement according to the invention.

Figure 13:
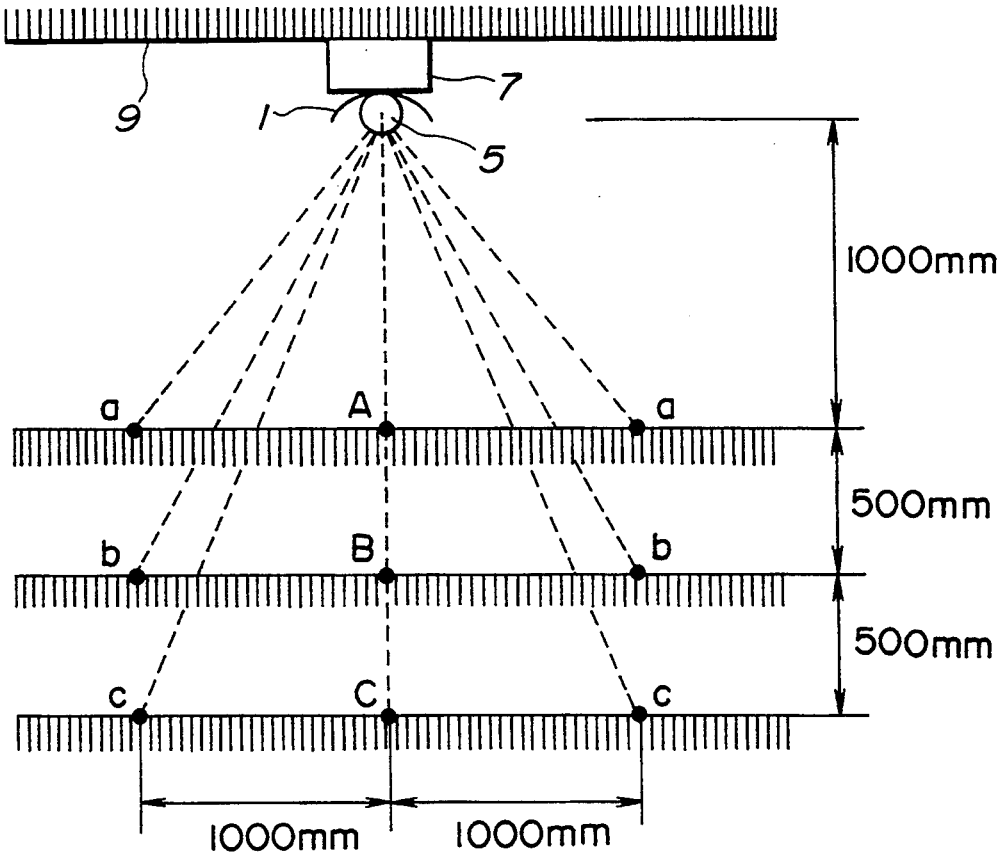
FIG. 13 is a graph illustrating illuminating effects obtained by the apparatus of the invention.

For the experiment, a standard FL40SS-EX-N/37 fluorescent lighting tube 5, manufactured by Matsushita Electronics Co. Ltd. (Matsushita Denki Sangyou Kabushiki Kaisha) was utilized, mounted on a ceiling 9 via a base 7 and mounting brackets 8 as discussed in relation to FIG. 1. Measurements are given in Lux (a standard unit of measuring illumination) measured by a LUX-METER LX-3010 manufactured by Miwa Co. Ltd. (Kabushiki Kaisha Miwa) and, referring to FIG. 13 were taken both with and without a reflective sheet 1. The reflective sheet 1 when used, was secured by retainers 42, 42 of the clip shown in FIG. 2 to establish curve B for the reflective sheet 1. The measurement positions were A, 1000 mm directly vertically below the lighting tube 5, B, 500 mm directly below position A and C. 500 mm directly below position B. Other measurements were taken at positions a, a, 1000 mm to either side of position A on the same plane thereof, b, b, 1000 mm to either side of position B on the same plane thereof, and positions c, c, 1000 mm to either side of position C on the same plane thereof. The results of the illumination tests are given in the following Table 1.

TABLE 1

| MEASUR--MENT PO-SITION | TOTAL LIGHT WITH-OUT REFLEC-TIVE SHEET | TOTAL LIGHT WITH REFLEC-TIVE SHEET | AMOUNT OF ILLUMINA-TION INCREASE | PER-CENT-AGE OF IN-CREASE |
|---|---|---|---|---|
| A | 500 Lux | 745 Lux | 245 Lux | 49% |
| a | 200 Lux | 250 Lux | 50 Lux | 25% |
| B | 250 Lux | 390 Lux | 140 Lux | 58% |
| b | 145 Lux | 210 Lux | 65 Lux | 45% |
| C | 150 Lux | 240 Lux | 90 Lux | 60% |
| c | 120 Lux | 150 Lux | 30 Lux | 25% |

As may be appreciated, significant improvement in lighting efficiency is realized by the reflective arrangement according to the invention. Generally speaking an improvement in lighting efficiency of between 25 and 60% may be realized by the arrangement of the invention. In addition, the reflective arrangement of the invention is simple and inexpensive to produce and easy to install, and may easily be retrofitted to existing fluorescent lighting systems without need of remounting or extensively renovating the existing lighting system.

Further, according to the invention, since a plurality of retainers 41–43 may be provided along the extending arm portions 40, an angle of a reflecting sheet 1 may be adjusted such that energy is not wasted by casting light into corners or against walls where lighting is not required. Thus an available amount of lights and lighting energy may be put to fullest possible use without significant additional expense.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A light reflecting arrangement for a lighting tube, comprising:

a reflective film having resilient flexible properties and being provided with a highly reflective finish on at least one side thereof;

a pair of molding portions of a length selected to be substantially equal to a longitudinal length of said reflective film and being attached to opposing longitudinal edges thereof respectively; and at least one clip having a pair of engaging arm portions extending in one vertical direction, a configuration of said pair of engaging arm portions selected so as to partially encircle the lighting tube, said at least one clip further comprising at least one second arm portion extending outwardly of said engaging arm portions in a direction which is substantially perpendicular to the longitudinal direction of said lighting tube, said at least one second arm portion having a plurality of retainers formed at predetermined intervals therealong, said retainers configured so as to be attachable to said molding portions.

2. A light reflecting arrangement as set forth in claim 1, wherein said at least one second arm portion comprises a pair of second arm portions extending outwardly from said engaging arm portions in mutually opposite directions substantially perpendicular to the longitudinal direction of said lighting tube.

3. A light reflecting arrangement as set forth in claim 2, wherein each of said second arm portions is respectively provided with a plurality of retainers spaced along the length thereof.

4. A lighting reflecting arrangement as set forth in claim 1, wherein said at least one clip comprises a pair of clips, which are employed positioned at substantially opposite ends of said lighting tube.

5. A lighting reflecting arrangement as set forth in claim 1, wherein said at least one clip comprises at least one pair of end clips and said at least one second arm portion comprises a single second arm portion, and wherein said single engaging arm portion of said each end clip respectively engages an outermost lighting tube in an arrangement in which a plurality of lighting tubes is mounted such that the respective second arm portions of said each end clip extends outwardly of said outermost lighting tubes so as to mount said reflective sheet over and above said plurality of lighting tubes.

6. A light reflecting arrangement as set forth in claim 5, further comprising an additional clip which includes a pair of engaging arm portions arranged at a center thereof, and having dimensions selected so as to partially encircle a center lighting tube of said plurality of lighting tubes, said additional clip further comprising a pair of second arm portions extending outwardly of said engaging arm portions in mutually opposite directions substantially perpendicular to the longitudinal direction of said lighting tube and having a retainer formed on each of said second arm portions respectively, said retainer being of a configuration so as to enable said retainer to be detachably connected to said molding portions.

7. A light reflecting arrangement as set forth in claim 1, wherein a first side of said molding includes a convex portion and a second side thereof is formed with a corresponding concave portion such that an edge portion of said reflective film is held therebetween according to squeezing pressure applied to said molding.

8. A light reflecting arrangement as set forth in claim 1, wherein and edge portion of said molding is press fitted to said edge of said reflective plate.

9. A light reflecting arrangement as set forth in claim 1, wherein said reflective film has an aluminum vapor finish.

10. A light reflecting arrangement as set forth in claim 1, wherein said reflective film has a transparent heat resistant protective layer in front of a reflecting side thereof.

11. A light reflecting arrangement as set forth in claim 10, wherein said heat resistant protective layer is tinted for effecting color adjustment of reflected light from said lighting tube.

12. A light reflecting arrangement as set forth in claim 1, wherein said reflective film has a transparent heat resistant protective layer in front of a reflecting side thereof and a protective oxidization preventing layer backing said reflecting side.

13. A light reflecting arrangement as set forth in claim 1, wherein said retainers are Y-shaped.

14. A light reflecting arrangement as set forth in claim 13, wherein said retainers have inwardly directed hook portions formed on distal ends thereof.

15. A light reflecting arrangement as set forth in claim 1, wherein said reflective film includes a plurality of transparent window portions spaced along the longitudinal center thereof and of a width equal to or smaller than a width of said lighting tube.

16. A light reflecting arrangement as set forth in claim 1, wherein said reflective film includes a plurality of narrow transparent bands formed substantially in parallel along the longitudinal center thereof and having reflective portions present therebetween.

17. A light reflecting arrangement for a lighting tube, comprising:

a reflective film having resilient flexible properties and being provided with a highly reflective finish on at least one side thereof:

a pair of molding portions of a length selected to substantially equal to a longitudinal length of said reflective film and being attached to opposing longitudinal edges thereof respectively, wherein said molding portion comprises a substantially thick edge portion and a surface reinforcing portion which is substantially planar and of lesser thickness than said edge portion, said surface reinforcing portion being disposed along a respective longitudinal edge of said reflective sheet, and is parallel therewith, and a width dimension of said surface reinforcing portion is greater than that of said thick edge portion so as to support said longitudinal edge of said reflective sheet such that said edge portion may be firmly supported without damage to said reflective sheet; and at least one clip having a pair of engaging arm portions extending in one vertical direction, a configuration of said pair of engaging arm portions selected so as to partially encircle the lighting tube, said at least one clip further comprising at least one second arm portion extending outwardly from said engaging arm portions in a direction which is substantially perpendicular to the longitudinal direction of said lighting tube, said at least one second arm portion having a retainer formed thereon, said retainer being of a configuration so as to be attached to said molding portions.

18. A light reflecting arrangement as set forth in claim 17, wherein said reinforcing surface portion is adhered to an edge of said reflective film.

19. A light reflecting arrangement as set forth in claim 17, wherein said at least one clip comprises a pair of clips.

20. A light reflecting arrangement for a lighting tube, comprising:

a reflective film having resilient flexible properties and being provided with a highly reflective finish on at least one side thereof:

a pair of molding portions of a length selected to substantially equal to a longitudinal length of said reflective film and being attached to opposing edges thereof respectively; and at least one clip having a pair of engaging arm portions extending in one vertical direction, a configuration of said pair of engaging arm portions selected so as to partially encircle the lighting tube, said at least one clip further comprising at least one second arm portion extending outwardly from said engaging arm portions in a direction which is substantially perpendicular to the longitudinal direction of said lighting tube, said at least one second arm portion having a retainer formed thereon, said retainer being of a C-shaped configuration with hook portions formed on the distal end thereof so as to be attached to said molding portions.

21. A light reflecting arrangement as set forth in claim 20, wherein said at least one clip comprises a pair of clips.

22. A light reflecting arrangement for a lighting tube, comprising:

a reflective film having resilient flexible properties and being provided with a highly reflective finish on at least one side thereof, and said film further comprises a transparent window portion formed along a longitudinal center thereof, a width thereof being equal to or smaller than a width of said lighting tube:

a pair of molding portions of a length selected to substantially equal to a longitudinal length of said reflective film and being attached to opposing longitudinal edges thereof respectively; and at least one clip having a pair of engaging arm portions extending in one vertical direction, a configuration of said pair of engaging arm portions selected so as to partially encircle the lighting tube, said at least one clip further comprising at least one second arm portion extending outwardly from said engaging arm portions in a direction which is substantially perpendicular to the longitudinal direction of said lighting tube, said at least one second arm portion having a retainer formed thereon, said retainer being of a configuration so as to be attached to said molding portions.

23. A light reflecting arrangement as set forth in claim 22, wherein said at least one clip comprises a pair of clips.

24. A light reflecting arrangement as set forth in claim 3, wherein said reflective film has a reflective finish provided on front and back sides thereof.

* * * * *